US006142106A

United States Patent [19]

Overbey, Jr. et al.

[11] Patent Number: 6,142,106

[45] **Date of Patent: *Nov. 7, 2000**

[54] AIR INLETS FOR COMBUSTION CHAMBER OF WATER HEATER

[75] Inventors: Fred A. Overbey, Jr., Bristol, Tenn.; Zoran Valcic, Chatswood; Geoffrey Mervyn Whitford, Dundas, both of Australia

[73] Assignee: SRP 687 Pty Ltd., Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/138,371

[22] Filed: Aug. 21, 1998

[51] Int. Cl.[7] ..... F22B 37/02

[52] U.S. Cl. ..... 122/5.51; 122/17; 431/326

[58] Field of Search ..... 122/5.51, 13.1, 122/17, DIG. 7; 431/326, 328

[56] References Cited

U.S. PATENT DOCUMENTS

| | | | |
|---|---|---|---|
| 360,199 | 3/1887 | Boegler . | |
| 626,454 | 6/1899 | Brintnall . | |
| 736,153 | 8/1903 | Reynolds . | |
| 796,924 | 8/1905 | McCartney . | |
| 1,398,986 | 12/1921 | Warnock . | |
| 1,661,193 | 3/1928 | Newport . | |
| 1,692,839 | 11/1928 | Humphrey . | |
| 1,806,216 | 5/1931 | Plummer . | |
| 1,841,463 | 1/1932 | Barber et al. . | |
| 2,008,155 | 7/1935 | Ramsdell et al. . | |
| 2,036,136 | 3/1936 | Guarcello . | |
| 2,070,535 | 2/1937 | Hansen . | |
| 2,112,655 | 3/1938 | Morrow . | |
| 2,429,916 | 10/1947 | Belgau . | |
| 2,479,042 | 8/1949 | Gaines . | |
| 2,499,636 | 3/1950 | Finley . | |
| 2,559,110 | 7/1951 | Burwell . | |
| 3,139,067 | 6/1964 | Van Den Broek et al. . | |
| 3,161,227 | 12/1964 | Goss et al. . | |
| 3,741,166 | 6/1973 | Bailey | 122/23 |
| 3,920,375 | 11/1975 | Sanderson et al. . | |
| 3,947,229 | 3/1976 | Richter . | |
| 4,039,272 | 8/1977 | Elliot . | |
| 4,080,149 | 3/1978 | Wolfe . | |
| 4,177,168 | 12/1979 | Denny et al. . | |
| 4,191,173 | 3/1980 | Dedeian et al. | 126/350 R |
| 4,204,833 | 5/1980 | Kmetz et al. . | |
| 4,241,723 | 12/1980 | Kitchen . | |
| 4,510,890 | 4/1985 | Cowan . | |
| 4,519,770 | 5/1985 | Kesselring et al. . | |
| 4,639,213 | 1/1987 | Simpson . | |
| 4,641,631 | 2/1987 | Jatana | 122/14 |
| 4,742,800 | 5/1988 | Eising . | |
| 4,777,933 | 10/1988 | Ruark | 126/361 |

(List continued on next page.)

FOREIGN PATENT DOCUMENTS

| | | |
|---|---|---|
| 0 560 419 A2 | 9/1993 | European Pat. Off. . |
| 0 596 555 A1 | 5/1994 | European Pat. Off. . |
| 0 657 691 A1 | 6/1995 | European Pat. Off. . |
| 25 40 709 A 1 | 3/1977 | Germany . |
| 39 26 699 A 1 | 2/1991 | Germany . |
| 60-134117 | 7/1985 | Japan . |
| 62-162814 | 7/1987 | Japan . |
| WO 94/01722 | 1/1994 | WIPO . |

*Primary Examiner*—Teresa Walberg
*Assistant Examiner*—Gregory A. Wilson
*Attorney, Agent, or Firm*—Schnader Harrison Segal & Lewis

[57] ABSTRACT

A water heater that includes a water container, a combustion chamber, adjacent the water container, having at least one inlet to admit air and extraneous fumes into the combustion chamber, at least one inlet comprising a metal plate about 0.4 to 0.6 mm in thickness and through which pass a plurality of ports, the ports comprising a plurality of slots and holes, each slot having a quenching distance of about 0.6 mm, and each hole having a quenching distance in the range of about 0.7 to 0.8 mm and being capable of confining ignition and combustion of said extraneous fumes within the combustion chamber; and a burner associated with the combustion chamber and arranged to combust fuel to heat water in the container.

11 Claims, 3 Drawing Sheets

U.S. PATENT DOCUMENTS 4,790,268 12/1988 Eising .
4,817,564 4/1989 Akkala et al. ..... 122/17
4,823,770 4/1989 Loeffler .
4,863,370 9/1989 Yokoyama et al. .
4,869,232 9/1989 Narang .
4,872,443 10/1989 Ruark .
4,893,609 1/1990 Giordani et al. .
4,919,085 4/1990 Ishiguro .
4,924,816 5/1990 Moore, Jr. et al. .
4,960,078 10/1990 Yokoyama et al. .
5,020,512 6/1991 Vago et al. ..... 126/350 R
5,044,928 9/1991 Yokoyama et al. .
5,085,205 2/1992 Hall et al. .
5,197,456 3/1993 Ryno .
5,205,731 4/1993 Reuther et al. .
5,215,457 6/1993 Sebastiani .
5,240,411 8/1993 Abalos .
5,246,397 9/1993 Petter .
5,261,438 11/1993 Katchka ..... 137/15
5,317,992 6/1994 Joyce .
5,355,841 10/1994 Moore, Jr. et al. .
5,368,263 11/1994 Harrison .
5,385,467 1/1995 Sebastiani et al. .
5,397,233 3/1995 Eavenson et al. .
5,427,525 6/1995 Shukla et al. .
5,435,716 7/1995 Joyce .
5,448,969 9/1995 Stuart et al. .
5,494,003 2/1996 Bartz et al. .
5,511,516 4/1996 Moore, Jr. et al. ..... 122/17
5,520,536 5/1996 Rodgers et al. ..... 431/329
5,522,723 6/1996 Durst et al. .
5,531,214 7/1996 Cheek .
5,533,495 7/1996 Moore, Jr. ..... 126/350 R
5,556,272 9/1996 Blasko et al. .
5,575,274 11/1996 DePalma .
5,588,822 12/1996 Hayakawa et al. .
5,649,821 7/1997 Fogliani et al. .
5,674,065 10/1997 Grando et al. .
5,791,298 8/1998 Rodgers ..... 122/17
5,797,355 8/1998 Bourke et al. .
5,797,358 8/1998 Brandt et al. ..... 122/448.1
5,937,796 8/1999 Sebastiani ..... 122/13.1
5,941,200 8/1999 Boros et al. ..... 122/13.1

AIR INLETS FOR COMBUSTION CHAMBER OF WATER HEATER

FIELD OF THE INVENTION

The present invention relates to air inlets for water heaters, particularly to improvements to gas fired water heaters adapted to render them safer for use.

BACKGROUND OF THE INVENTION

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is common for such machinery to be refuelled in such locations.

There have been a number of reported instances of spilled gasoline and associated extraneous fumes being accidentally ignited. There are many available ignition sources, such as refrigerators, running engines, electric motors, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes", "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges are capable of enabling ignition are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite.

For example, the range for common gasoline vapor is between 3% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (e.g. propane and butane) or liquids which form fumes having a density close to that of air, (e.g. gasoline, which may contain butane and pentane among other components, is very typical of such liquid fuel).

In reconstructions of accidental ignition situations, when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The invention aims to substantially raise the probability of successful confinement of ignition of spilled flammable substances from typical spillage situations to the inside of the combustion chamber.

SUMMARY OF THE INVENTION

The invention includes a water heater having a water container, adjacent which is a combustion chamber having one or more inlets to admit air and any extraneous flammable fume species which may have escaped in the vicinity of the water heater into its combustion chamber.

In one particularly preferred form, an inlet comprises a metal plate of thickness about 0.5 millimeters thick and through which pass many ports of both slotted and circular shape, each of which has a width and diameter respectively defined as a quenching distance, such that the water heater is able to confine ignition and combustion of extraneous fume species within the combustion chamber; despite the presence of an ignition source in the form of burner(s) in the combustion chamber to combust fuel to heat the water in container.

DETAILED DESCRIPTION OF THE DRAWINGS

Figure 1:
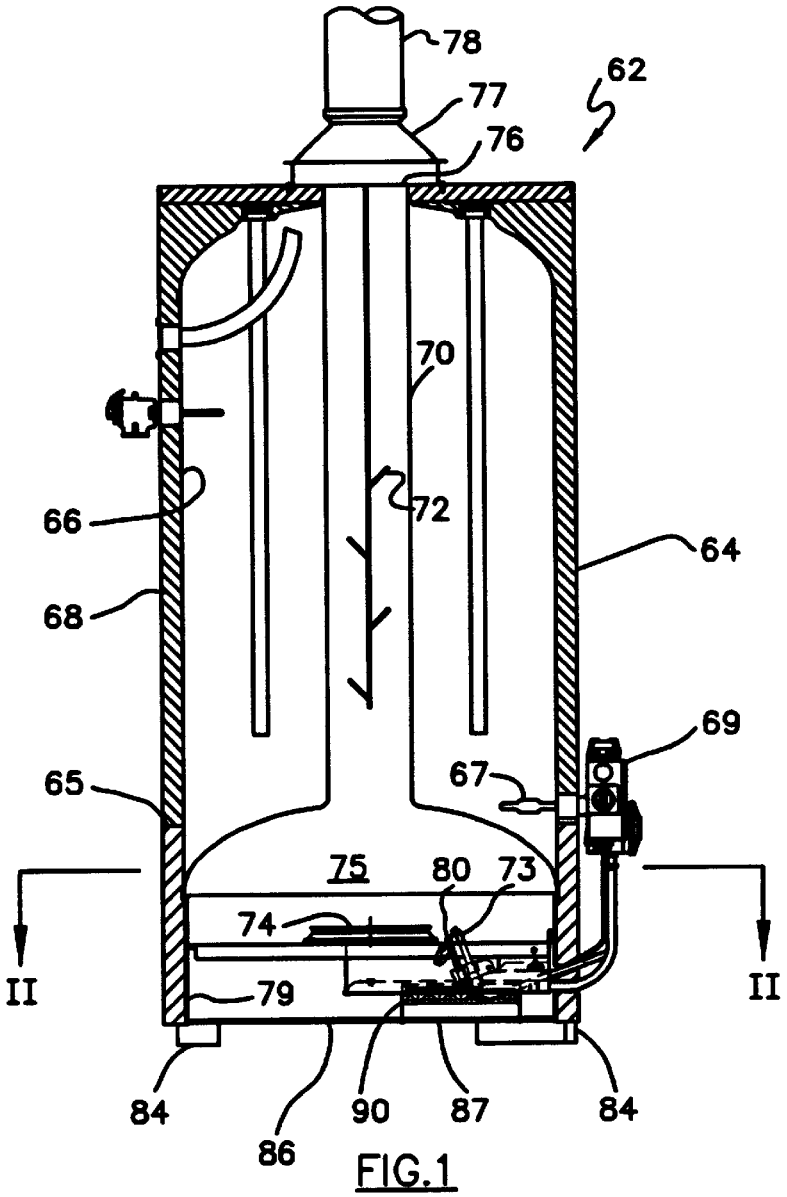
FIG. 1 is a schematic partial cross-sectional view of a gas-fuelled water heater having a single large air inlet according to the invention.

Conventional water heaters typically have their source(s) of ignition at a low level. They also have their combustion air inlets at or near floor level. In the course of attempting to develop appliance combustion chambers capable of confining flame inside appliances, we discovered that a type of air inlet constructed by forming holes in sheet metal in a particular way has particular advantages in damage resistance when located at the bottom of a heavy appliance such as a water heater which stands on a floor.

A thin sheet metallic plate having many ports of closely specified size formed, cut, punched, perforated, etched, punctured and/or deformed through it at a specific spacing provides an excellent balance of performance, reliability and ease of accurate manufacture. In addition, the plate provides damage resistance prior to sale and delivery of a fuel burning appliance such as a water heater having such an air intake and during any subsequent installation of the appliance in a user's premises.

On the other hand, both ceramic plaque tiles (such as Schwank tiles) and certain less robust types of woven metal mesh may be disadvantaged at times by tending to be more damage prone. Moreover, ceramic plaque tiles are typically 20 to 25 times thicker than the thin metallic plates or metal mesh and, therefore, may be disadvantaged to some extent by a much greater flow resistance per unit of area of air intake.

The invention addresses ways of meeting extreme conditions and selecting the significant parameters of the inlet plate so as not to permit external ignition by excessive heating of any extraneous fumes and air drawn in through the inlet plate. The invention also addresses ways of avoiding detonation wave type ignition that we discovered propagates from the inside to the outside of the combustion chamber through the inlet plate under certain circumstances, by minimizing the amount of flammable fumes which may enter the combustion chamber before initial ignition inside the combustion chamber occurs.

We found that the shape and the pattern of the ports in an air intake plate having the required air flow rate was significant in preventing detonation ignition and delaying or preventing temperature rise of the plate during prolonged combustion testing resulting from a spill.

It will be appreciated that the following description is intended to refer to the specific embodiments of the invention selected for illustration in the drawings and is not intended to limit or define the invention, other than in the appended claims.

Figure 2:
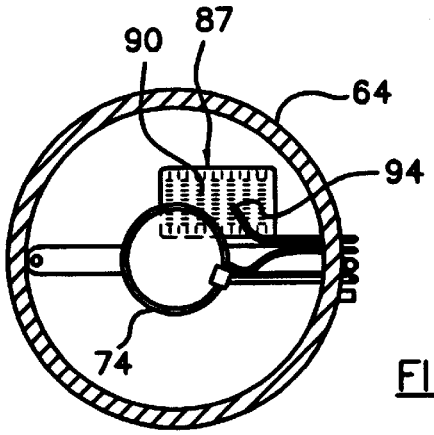
FIG. 2 is a cross-sectional view of a water heater of FIG. 1 taken through the line II—II in FIG. 1.

Turning now to the drawings in general and FIGS. 1 and 2 in particular, there is illustrated a storage type gas water heater 62 including jacket 64 which surrounds a water tank 66 and a main burner 74 in an enclosed chamber 75 that addresses and solves the longstanding problems described above. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam 65 separates foam insulation 68 and the fiberglass insulation.

Located underneath water tank 66 are a pilot burner 73 and main burner 74 which preferably use natural gas as their fuel or other gases such as LPG, for example. Other suitable fuels may be substituted. Burners 73 and 74 combust gas admixed with air and the hot products of combustion rise up through flue 70 possibly with heated air creating a suction pressure that draws ambient air into the combustion chamber 75, as will be further described below. Water tank 66 is lined with a glass coating for corrosion resistance. The thickness of the coating on the exterior surface of water tank 66 is about one-half of the thickness of the interior facing surface to minimize "fish scaling" of that coating. Also, the lower portion of flue 70 is coated inside to prevent eventual formation of scale that could detach as flakes of rust due to the prolonged effects of acidic condensate. Such flakes could fall into chamber 75 possibly blocking off or reducing air flow by lodging on the air inlet plate 90.

The fuel gas is supplied to both burners (73,74) through a gas valve 69. Flue 70 in this instance, contains a series of baffles 72 to better transfer heat generated by main burner 74 to water within tank 66. Near pilot burner 73 is a flame detecting thermocouple 80 which is a known safety measure to ensure that in the absence of a flame at pilot burner 73 the gas control valve 69 shuts off the gas supply. The water temperature sensor 67, preferably located inside the tank 66, co-operates also with the gas control valve 69 to supply gas to the main burner 74 on demand.

The products of combustion pass by natural convection upwardly and out the top of jacket 64 via flue outlet 76 after heat has been transferred from the products of combustion. Flue outlet 76 discharges conventionally into a draught diverter 77 which in turn connects to an exhaust duct 78 leading outdoors.

Water heater 62 is mounted preferably on legs 84 to raise the base 86 of the combustion chamber 75 off the floor. In base 86 is an aperture 87 which is closed gas tightly by an air inlet plate 90 which admits all required air for the combustion of the fuel gas combusted through the main burner 74 and pilot burner 73, regardless of the relative proportions of primary and secondary combustion air used by each burner. Air inlet plate 90 is preferably made from a thin perforated sheet of stainless steel.

Where base 86 meets the vertical combustion chamber walls or skirt 79, adjoining surfaces can be either one piece or alternatively sealed thoroughly to prevent ingress of air or flammable extraneous fumes. Gas, water, electrical, control or other connections, fittings or plumbing, wherever they pass through combustion chamber wall 79 are sealed. The combustion chamber 75 is air/gas tight except for means to supply combustion air through air inlet plate 90 and to exhaust combustion products through flue 70.

Pilot flame establishment can be achieved from outside the combustion chamber 75 by a piezoelectric igniter. A pilot flame observation window can be provided which is sealed.

Cold water is introduced at a low level of the tank 66 and withdrawn from a high level in any manner as already well known. During normal operation, water heater 62 operates in substantially the same fashion as conventional water heaters except that all air for combustion enters through air inlet plate 90. However, if spilled fuel or other flammable fluid is in the vicinity of water heater 62 then some extraneous fumes from the spilled substance may be drawn through plate 90 by virtue of the natural draught characteristic of such water heaters. Air inlet 90 allows the combustible extraneous fumes and air to enter but confines combustion inside the combustion chamber 75.

The spilled substance is burned within combustion chamber 75 and exhausted as combustion products, substantially carbon dioxide and nitrogen, through flue 70 via outlet 76 and duct 78. Because flame is confined by the air inlet plate 90 within the combustion chamber, and flue 70 is filled with an upwardly flowing blanket of flame extinguishing carbon dioxide and nitrogen, flammable substance external to water heater 62 will not be ignited.

As best seen in FIG. 2, the inlet plate has mounted on or adjacent its upward facing surface a thermally sensitive fuse 94 in series in an electrical circuit with pilot flame proving thermocouple 80 and a solenoid coil in gas valve 69.

Figure 4:
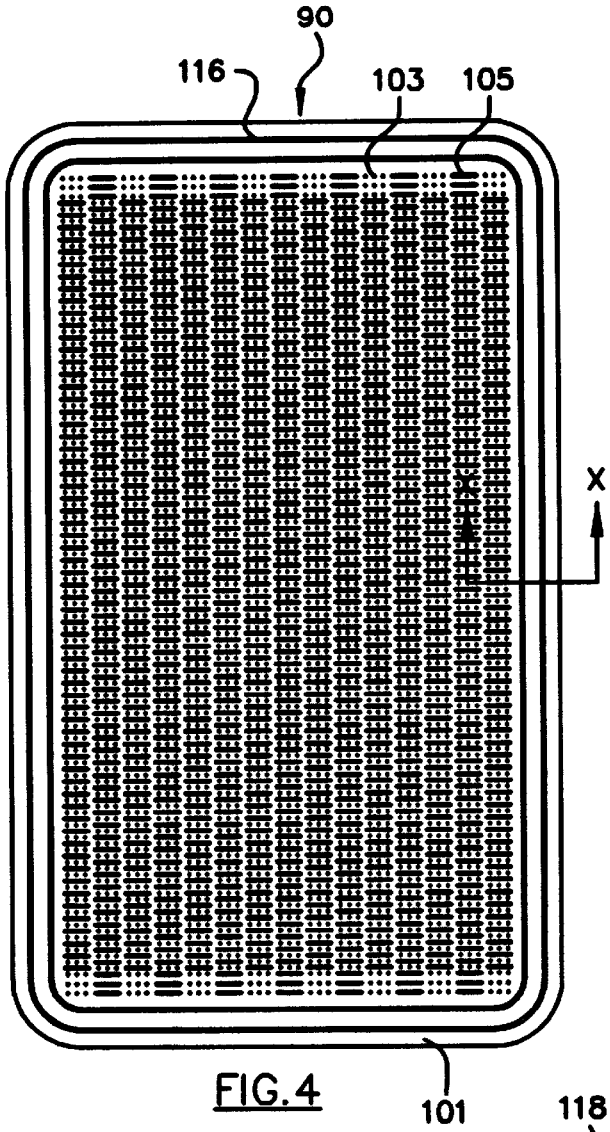
FIGS. 4–7 are, respectively, plan, cross-section, edge detail and partial cross-section, and attachment detail cross-section views of an air inlet plate according to the invention.
Figure 5:
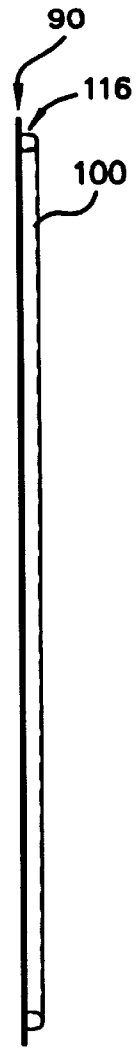
Figure 6:
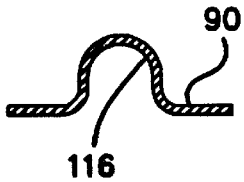

With reference to FIGS. 1, 2 and 4, the size of air inlet plate 90 is dependent upon the air consumption requirement for proper combustion to meet mandated specifications to ensure low pollution burning of the gas fuel. Merely by way of general indication, the air inlet plate of FIG. 1 should be conveniently about 3700 square mm in perforated area when fitted to a water heater having between 35,000 and 50,000 Btu/hr (approximate) energy consumption rating to meet U.S. requirements for overload combustion.

Figure 3:
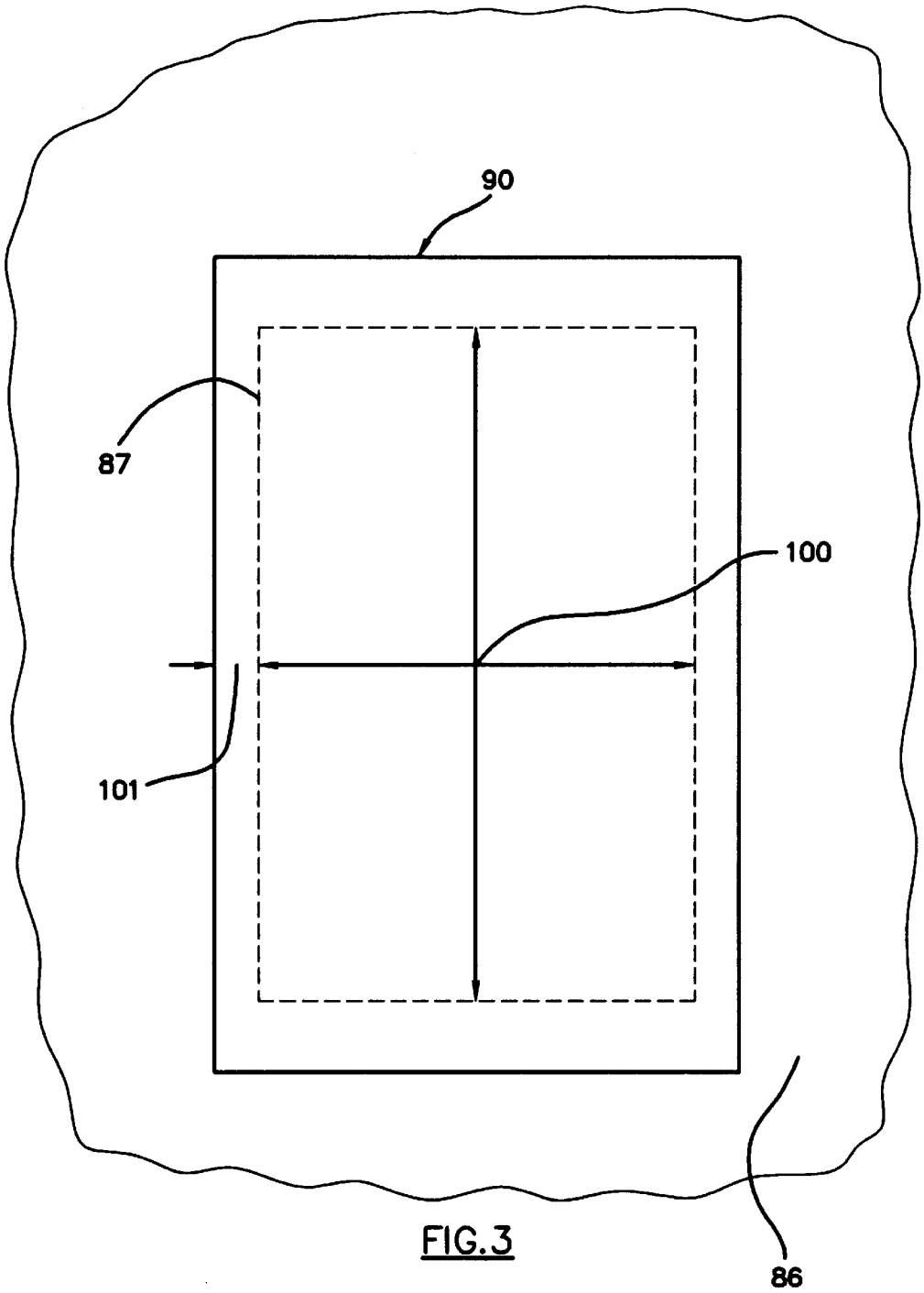
FIG. 3 is a schematic plan view depicting a portion of the base of a combustion chamber of a water heater including an air inlet.

FIG. 3 shows schematically an air inlet 90 to a sealed combustion chamber comprising an aperture 87 in a portion of the lower wall 86 of the combustion chamber and, overlapping the aperture 87, a thin sheet metal air inlet plate 90 having a perforated area 100 and an unperforated border 101.

Depending on the metal selected for plate 90 and its mechanical properties, the thickness can lie within a practicable range. For example, for plates 90 of grades 409, 430 or 316 stainless steel, about 0.6 mm thickness is preferred. Of course, other materials may be used.

In FIG. 4 slots 105 and holes allow sufficient combustion air through the inlet plate 90 and there is no exact restriction on the total number of slots 105 and holes or total area of the plate, both of which are determined by the capacity of a chosen gas (or fuel) burner to generate heat by combustion of a suitable quantity of gas with the required quantity of air to ensure complete combustion in the combustion chamber together with the size and spacing of the slots 105 and holes. The air for combustion passes through the slots 105 and holes and not through any larger inlet air passage or passages to the combustion chamber, no such larger air inlet being provided.

Figure 8:
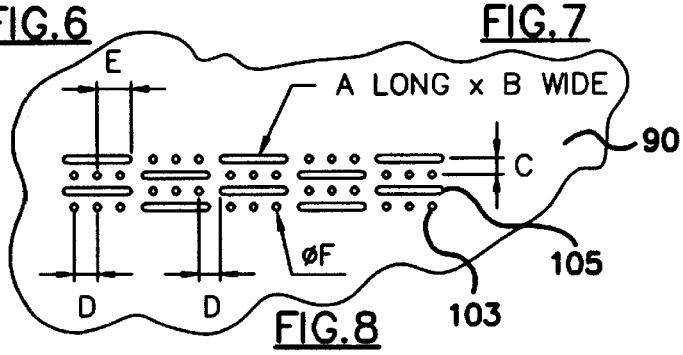
FIG. 8 is a detail view of the spacing and dimensions of part of the arrangement of ports on the inlet plate of FIG. 4.

FIG. 4 shows one pattern we found particularly suitable with a pattern of parallel slots 105 having for most of the perforated area of the plate 90 both the longer and shorter side of each adjacent slot 105 separated by a row of holes. At either end of each vertical column of holes 103 and slots 105 the pattern differs in that the first three openings in the first and last columns are all rows of three holes 103 and in all intervening columns alternate as three parallel slots 105 and three rows of three holes 103. FIG. 8 shows preferred dimensions of the slots 105 and holes and the spacing between them by the reference designation letters A to F.

We found that the quenching distance for the holes and slots in about 0.45 to 0.55 mm thickness metal plate should be in the range of about 0.7 to 0.8 mm for the holes and about 0.6 mm for the slots.

The term "quenching distance" as used hereinafter applies to any one port in an inlet plate in a combustion chamber of a water heater or similar appliance to account for a variety of suitable shapes of port. In plan view a suitable shape of port may most conveniently be a geometrically regular figure which is symmetrical about one or more straight line axes passing through the centroid of that open area, as for example, a circle, triangle, square, rectangle, parallelogram, rhombus or polygon with more than four equal sides. This would also include a slot or other figure with straight sides in which radiused corners or curves may join such straight sides.

We define the "quenching distance" of a port in an inlet plate in a combustion chamber of a water heater or similar appliance to account for a wide variety of suitable shape of port. The quenching distance in this context is that distance measured in the plane of the port area below which a flame formed by a combustible mixture of a fume species and air passing or having passed through the port in a forward direction will not propagate through the port in a reverse direction, whether as a result of detonation or deflagration type initiation of combustion or as a result of prolonged steady combustion at the inlet plate within the combustion chamber.

For shapes of ports such as may be categorized as geometrically regular such as circular holes or straight slots, we define the quenching distance of such a port by first defining an axis of the open area of that port as the longer or longest line, which may be straight or curved, which divides that open area in half, exactly or approximately. The quenching distance of that port is then the length of the longest straight line that passes perpendicularly through the defined axis to meet the boundary of the open area. Thus the quenching distance according to this definition for a straight slot having semicircular ends joining the longer sides that we prefer is its width and, for a circle, its diameter. For the avoidance of doubt, in the case of four-sided figures where the longer axis could join diagonally opposite corners, the defined axis is that axis which bisects opposite sides. Thus, for a square for example the quenching distance is equal to the side length, not the diagonal.

For both geometrically regular and irregular shapes of port, complex patterns may be formed by superimposing shapes where axes may cross or intersect, in many ways, one example being wavy slots intersecting perpendicularly or, another, formed from straight lines creating an irregular star-like shape or the like.

To form the slots 105 and holes 103 one of several manufacturing operations are appropriate. Such operations include laser cutting, etching, photochemical machining, stamping, punching, blanking or piercing.

We found a suitable quenching distance for hole and slots 105 can best be determined with the assistance of some experimental observations for a given design of air inlet plate 90 in a water heater 62 having a combustion chamber 75. The defined quenching distance is affected by the following factors:

- The incoming air and extraneous fume temperature, as affected by preheating;
- The ratio between extraneous fumes and air;
- The nature of the extraneous fumes in relation to its flame speed and flammability limits in combination with air as an oxidant;
- Appliance design related variables, including flue length and, therefore, the velocity of input air and extraneous fume mixtures and pressure difference across the air inlet plate 90;
- The size and shape of the chosen air inlet ports and 105 and their spacing;
- Internal construction of combustion chamber 75 relative to the main burner 74 positioning and the air inlet plate 90 positioning including effects of back radiation from the burner to the air inlet plate 90 and any other internal or external restrictions to air flow through the air inlet plate 90 and out through the exhaust flue 70; and
- The material of the air inlet plate 90 including its thermal conductivity, the emissivity of its surface and the effect of any catalytic substance having combustion influence applied to its surface.

The dimensions of the slots are substantially equal and have a length L of about 6 mm and a width W of about 0.5 mm. The ends of each slot are substantially semicircular because metal blanking such large numbers of holes can be difficult as regards maintaining good condition of the small punches required if the corner radii are not semicircular or at least rounded. The photochemical machining process of manufacture of plates 90 with slots 105 and holes is better adapted to also produce radiused cornered slots.

The interport spacing illustrated performs the required confinement function in the previously described situation. Especially suitable dimensions for the designations indicated in FIG. 8 are as follows:

A=6 mm; B=0.5 mm; C=1.2 mm; D=2 mm; E=3 mm; F=0.75 mm diameter.

The illustrated pattern is repeated across the entire perforated area of the plate.

We found the slot length A not to be critical. A range of about 4 mm to about 8 mm is suitable for many applications. The closest spacing between adjacent ports is, as illustrated, 0.575 mm. This can be varied upward but we prefer not to exceed about 1 mm since the plate 90 then becomes unnecessarily large.

The dimensions and spacing of slots 105 and holes as stated above and the pattern shown in FIG. 4 having a rectangular area containing holes and slots 105 have width and length dimensions of 102×186 mm. This inlet plate 90, during one testing procedure using a U.S. 40-gallon heater, allowed passage of fumes of spilled gasoline through the inlet plate 90 where they ignited inside the combustion chamber 75 and burned until 1 U.S. gallon that was spilled and formed the fumes was consumed. This was done without the temperature of the gasoline fumes entering the inlet plate 90 reaching a temperature sufficient to ignite the gasoline which had not yet passed through the inlet plate 90, the test concluding when no more gasoline vapor from the spilled gasoline remained to be consumed after more than one hour of continuous burning.

Figure 7:
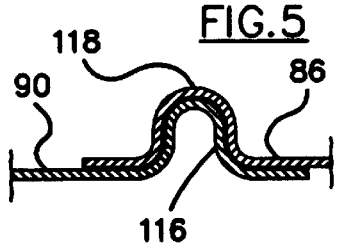

FIGS. 4 to 7 illustrate the rectangular inlet plate 90 comprising a perforated central portion 105 bounded by a non-perforated portion 101 which is formed to include a peripheral channel 116. The peripheral channel 116 is shaped to enable the inlet plate 90 tightly to engage, or otherwise to snap into a mating connection 118 as shown in FIG. 7 formed around an opening 87 as shown in FIG. 3 in the base 86 of the combustion chamber 75. The combustion chamber 75 with inlet plate 90 fitted is enclosed at the top by a mating connection to or adjacent the outside periphery of the curved base of the tank 66 of a water heater 62 and so forms a closed combustion chamber 75. Those potential sources of ignition of extraneous fumes forming part of a water heater 62, namely burners 73 and 74 are enclosed by location in the combustion chamber 75. The combustion chamber wall or skirt 79 supports the mass of water tank 66. The peripheral channel 116 in the inlet plate 90 and the mating peripheral groove 118 surrounding the opening 87 in the base 86 of the combustion chamber 75 frictionally engage to seal it. The groove 118 can also function as a dam to exclude any condensed moisture accumulating on base 86 of the combustion chamber 75 from spreading across the perforated areas 105 of the plate 90.

It is to be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art, can be made to them without departing from the scope of the present invention.

What we claim is:

1. A water heater comprising:

a water container;

a combustion chamber, adjacent said water container, having at least one inlet to admit air and extraneous fumes into said combustion chamber, said at least one inlet comprising a metal plate about 0.4 to 0.6 mm in thickness and through which pass a plurality of ports, the ports comprising a plurality of slots and holes, each slot having a quenching distance of about 0.6 mm, and each hole having a quenching distance in the range of about 0.7 to 0.8 mm and being capable of confining ignition and combustion of said extraneous fumes within said combustion chamber; and a burner associated with said combustion chamber and arranged to combust fuel to heat water in said container.

2. The water heater defined in claim 1, wherein said slots have a length between about 4 mm to about 8 mm.

3. The water heater defined in claim 1, wherein said ports have a minimum distance between adjacent boundaries of about 1 mm.

4. The water heater defined in claim 3, wherein said minimum distance between adjacent ports is substantially the same.

5. The water heater defined in claim 1, wherein said slots are arranged in rows.

6. The water heater defined in claim 5, wherein a first slot in every alternate row has its location offset with respect to a port of an adjacent row.

7. The water heater defined in claim 1, wherein said slots and holes are arranged in a pattern comprising an aligned and spaced array.

8. The water heater defined in claim 1, wherein during combustion of said extraneous fumes over a prolonged period, heating of the extraneous fumes and air before passing through said at least one inlet is not sufficient to raise said fumes and air to a temperature above an ignition temperature of said extraneous fumes and air.

9. The water heater defined in claim 1, wherein said ports are spaced apart on said at least one inlet by a distance which enables the temperature of mixtures of extraneous fumes with air adjacent to surfaces of the walls of said ports to remain below an ignition temperature of said mixtures.

10. The water heater defined in claim 1, further comprising an outlet spaced apart from said at least one inlet allowing products of combustion to exit said combustion chamber.

11. The water heater defined in claim 1, further comprising a metal to metal overlap portion between a peripheral edge of said plate forming said at least one inlet and a peripheral edge of an opening in said combustion chamber.

* * * * *